US005562048A

United States Patent [19]

Gottlieb

[11] Patent Number: 5,562,048

[45] Date of Patent: Oct. 8, 1996

[54] STRUCTURALLY STRONG PALLET FACILITATING EASY MANUFACTURE FABRICATED FROM A STIFF FOLDABLE MATERIAL

[75] Inventor: Norman J. Gottlieb, Thornhill, Canada

[73] Assignee: Container Corporation International Inc., Barbados, Barbados

[21] Appl. No.: 348,466

[22] Filed: Dec. 2, 1994

[51] Int. Cl.[6] ..... B65D 19/00

[52] U.S. Cl. ..... 108/51.3

[58] Field of Search ..... 108/51.3, 51.1, 108/56.1, 56.3

[56] References Cited

U.S. PATENT DOCUMENTS

| | | | |
|---|---|---|---|
| 3,602,158 | 8/1971 | Skaggs | 108/51.3 |
| 3,626,860 | 12/1971 | Blatt | 108/51.3 |
| 3,911,834 | 10/1975 | Quaintance | 108/51.3 |
| 4,759,295 | 7/1988 | Nilsen et al. . | |
| 4,792,325 | 12/1988 | Schmidtke . | |
| 4,867,074 | 9/1989 | Quasnick . | |
| 5,176,090 | 1/1993 | Roberts et al. | 108/51.3 |
| 5,195,440 | 3/1993 | Gottlieb . | |
| 5,222,444 | 6/1993 | Youell, Jr. et al. | 108/51.3 |
| 5,272,989 | 12/1993 | Johnston et al. | 108/51.3 |
| 5,285,731 | 2/1994 | McIntyre | 108/51.3 |
| 5,285,732 | 2/1994 | Gottlieb . | |
| 5,370,062 | 12/1994 | Johnston et al. | 108/51.3 |
| 5,377,600 | 1/1995 | Speese et al. | 108/51.3 |

*Primary Examiner*—Jose V. Chen

*Attorney, Agent, or Firm*—Testa, Hurwitz & Thibeault, LLP

[57] ABSTRACT

A pallet is fabricated from a sheet of stiff foldable material with each end of the sheet having four transverse score lines. A right angle fold is made about each score line so that each end portion of the sheet is folded back on itself into a rectangular runner with a flap (between the end of the sheet and the adjacent score line) lying adjacent the sheet. The flap is adhered to the sheet. Blocks may simply be inserted into the runners to stabilize them. Alternatively, at each end portion of the sheet tabs may be formed in one of the zones of the sheet which are defined by adjacent transverse score lines and between the end of the sheet and its adjacent score line. Slots are formed in another zone with one zone intervening between the tabs and slots. With this embodiment, after the end portions of the sheet are folded into runners, the tabs are folded toward the slots so as to be received within the slots in order to support the runners. The tabs may have an end portion with a glue pad which folds back to lie adjacent a runner wall so that the glue pad adheres the end portion to the runner wall.

7 Claims, 11 Drawing Sheets

STRUCTURALLY STRONG PALLET FACILITATING EASY MANUFACTURE FABRICATED FROM A STIFF FOLDABLE MATERIAL

BACKGROUND OF THE INVENTION

1. Field of the Invention

The present invention relates to a pallet blank fabricated from a stiff foldable sheet and a pallet comprising such a sheet.

2. Description of the Related Art

It is desirable that a pallet be lightweight, economical and recyclable. U.S. Pat. Nos. 4,792,325 and 4,867,074 disclose corrugate pallets having intersecting stringers and runners forming a platform, with the stringers and runners separately constructed of multi-layered panels, which are relatively expensive to produce. U.S. Pat. Nos. 5,195,440 and 5,285,732 disclose pallets fabricated from a sheet of stiff foldable material, such as corrugate. While these pallets are quite economical to produce, they still require a number of complicated cuts and folds in their construction.

Accordingly, there remains the need for a pallet facilitating easy manufacture and fabricated from a stiff foldable material.

SUMMARY OF THE INVENTION

According to this invention, there is provided a pallet blank fabricated from a stiff foldable sheet having two opposed ends and two opposed sides, said blank comprising: proximate each end of said sheet: a first transverse score line parallel to said end of said sheet and adjacent thereto and extending from one side of said sheet to a second side of said sheet, such that a first zone is defined between said first score line and said end; a second transverse score line parallel to said end of said sheet and adjacent to said first score line and extending from said one side of said sheet to said second side of said sheet, such that a second zone is defined between said second score line and said first score line; a third transverse score line parallel to said end of said sheet and adjacent to said second score line and extending from said one side of said sheet to said second side of said sheet, such that a third zone is defined between said third score line and said second score line; a fourth transverse score line parallel to said end of said sheet and adjacent to said third score line and extending from said one side of said sheet to said second side of said sheet, such that a fourth zone is defined between said fourth score line and said third score line; said second zone and said fourth zone having substantially the same width; and said first zone and said third zone having substantially the same width. One of the first zone, the second zone, the third zone, and the fourth zone, have a plurality of linear slots and another of said first zone, said second zone, said third zone, and said fourth zone, which is spaced from said one zone by an intervening zone, have a like plurality of linear score lines and a like plurality of cut lines, each of said another zone score lines being aligned in an end-to-end direction with an associated one of said slots, each of said cut lines beginning and ending at an associated one of said another zone score lines such that said cut line with said associated another zone score line defines a tab, with a first perpendicular distance from said associated third zone score line to a portion of said cut line being greater than the width of said intervening zone.

BRIEF DESCRIPTION OF THE DRAWINGS

In the drawings which disclose example embodiments of the invention.

DETAILED DESCRIPTION OF THE PREFERRED EMBODIMENTS

Figure 1:
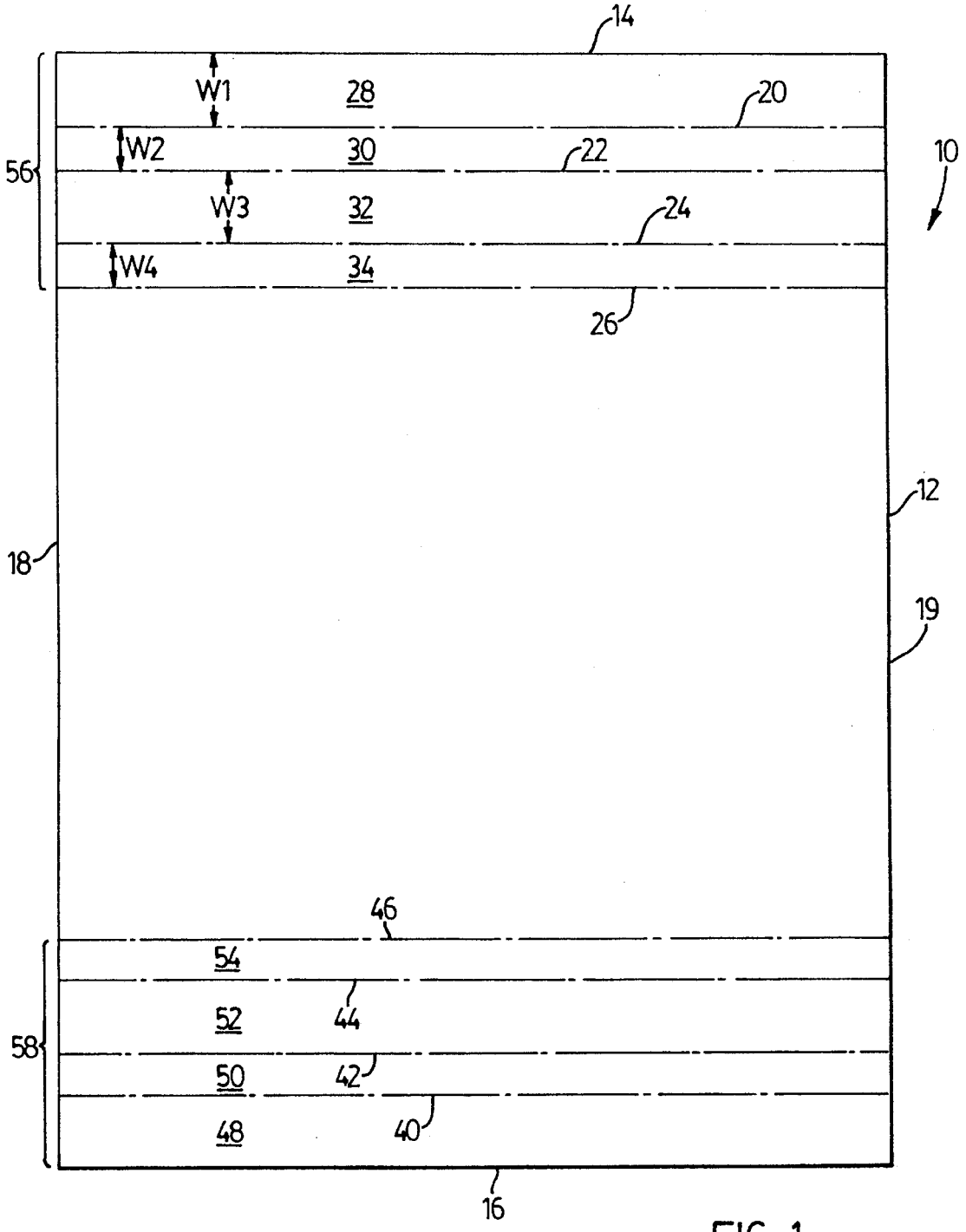
FIG. 1 is a plan view of a pallet blank fabricated from a stiff foldable sheet made in accordance with this invention.

With reference to FIG. 1, a pallet blank 10 is fabricated from sheet 12. The sheet is made of a stiff foldable material, which material is typically corrugate. Sheet 12 has opposed ends 14 and 16 and opposed sides 18 and 19. A series of first, second, third, and fourth transverse score lines 20, 22, 24, 26, respectively, extend parallel to end 14 and proximate to this end from side 18 to side 19 of the sheet 12. The first transverse score line 20 defines a first zone 28 between itself and end 14. The second transverse score line 22 defines a second zone 30 between itself and the first score line. The third transverse score line 24 defines a third zone 32 between itself and the second transverse score line and the fourth transverse score line 26 defines a fourth zone 34 between itself and the third transverse score line. The first zone 28 has a width W1 which is equal to the width W3 of the third zone.

Also, the width W2 of the second zone 30 is the same as the width W4 of the fourth zone 34.

Similarly to end 14, a series of first, second, third and fourth transverse score lines 40, 42, 44, and 46, respectively, extend between sides 18 and 19 of sheet 12 proximate end 16. The score lines proximate end 16 define first, second, third and fourth zones 48, 50, 52, and 54, respectively, with the first and third zones having the same width and the second and fourth zones having the same width.

The four zones 20, 22, 24, 26 define end portion 56 of the sheet and the four zones 48, 50, 52, 54 define end portion 58 of the sheet.

Figure 2:
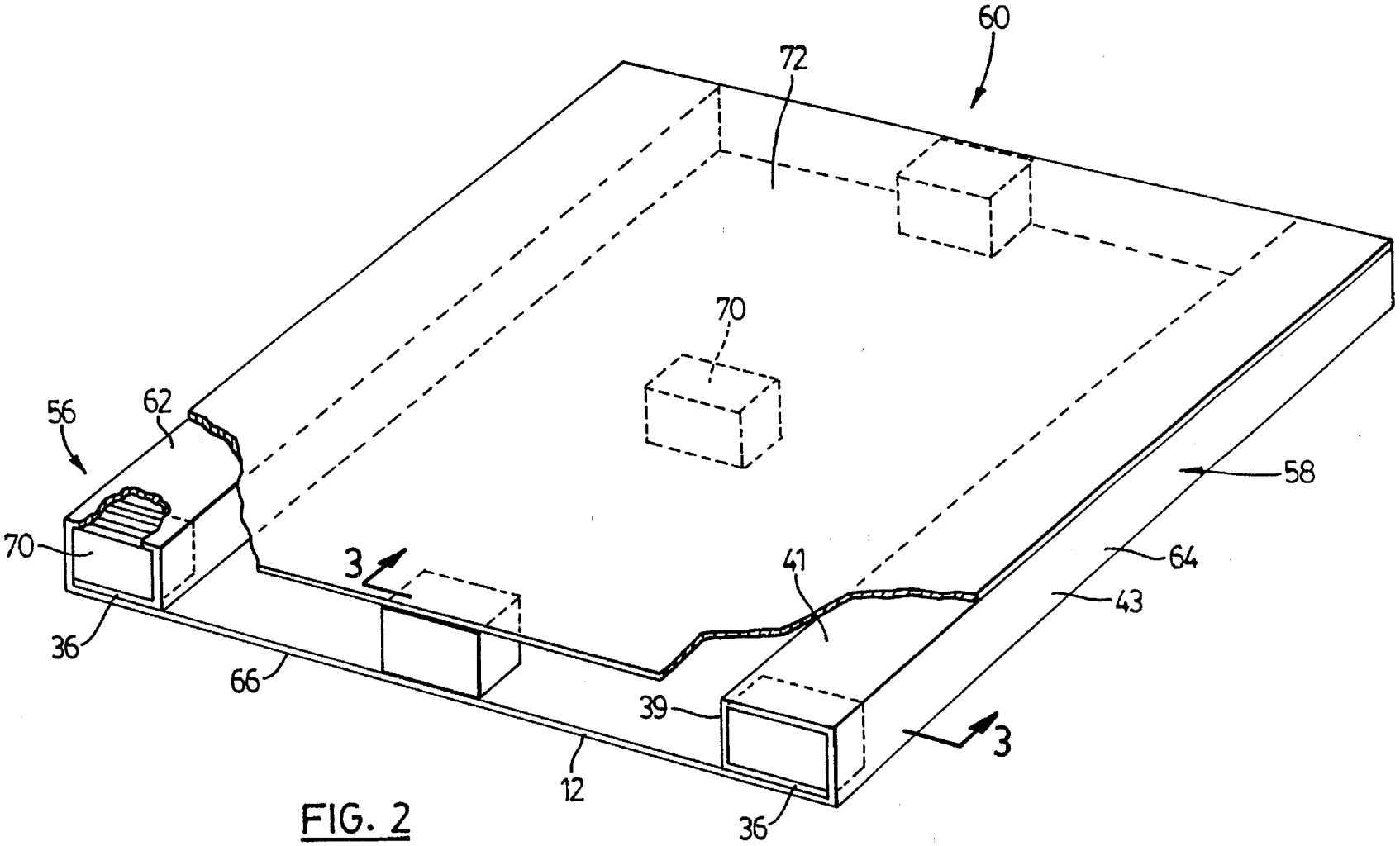
FIG. 2 is a perspective view of a pallet incorporating the sheet of FIG. 1.
Figure 3:
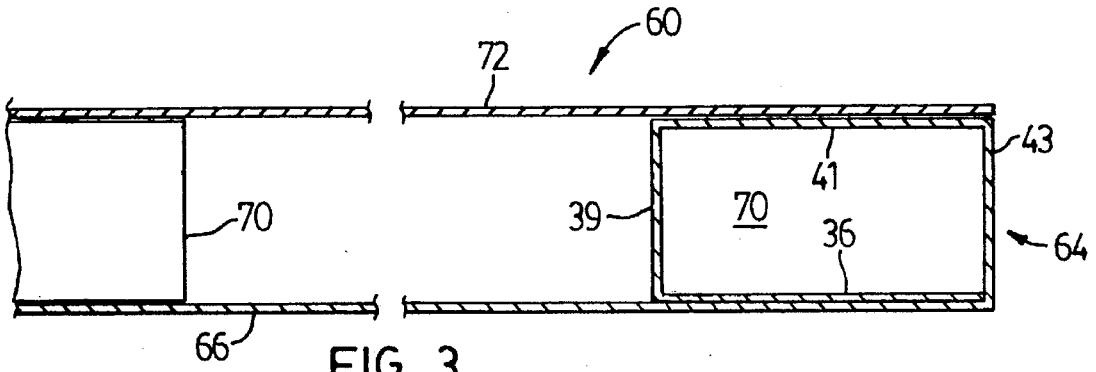
FIG. 3 is a cross-sectional view along the lines 3—3 of FIG. 2.

The pallet blank of FIG. 1 may be formed into a pallet by folding the sheet 12 along each of the score lines 20, 22, 24, 26, 40, 42, 44, and 46. More particularly, a right angle fold may be made at each score line with all of the folds in one end portion of the sheet being made in the same sense such that the end portions of the sheet 56 and 58 fold back on themselves. FIGS. 2 and 3 illustrate the result. Referencing FIG. 1 along with FIGS. 2 and 3, it will be noted that the pallet 60 of FIGS. 2 and 3 comprises sheet 12 with the end portions 56 and 58 of the sheet folded into transverse runners 62 and 64, respectively. After the end portions have been folded, the first zones 28, 48 of blank 10 comprise flaps 36 of pallet 60 which lie adjacent a deck portion 66 of the pallet, the second zones 30, 50 comprise inside side walls 39 of the runners, the third zones 32, 52 of the sheet comprise base walls 41 of the runners and the fourth zones 34, 54 comprise outside side walls 43 of the runners. Flaps 36 are affixed to deck portion 66 with glue or staples.

Referring solely to FIGS. 2 and 3, each transverse runner 62, 64 contains one or more reinforcing blocks 70 sized to fit snugly inside the runner. These blocks may comprise a series of corrugate plates which are glued together. Additional blocks 70 may be glued along the middle of deck 66 between runners 62 and 64, as illustrated in FIGS. 2 and 3. A second deck sheet 72 extends between the outside side walls 43 of the runners 62, 64 over base walls 41 and is glued or stapled to the base walls of the runners. The second deck 72 is also glued to any reinforcing blocks 70 which are medially positioned on deck 66.

It will be noted that only a scoring machine is required to fabricate the pallet blank 10 of FIG. 1. No perforations or cuts are required in the sheet 12. Also, since the score lines are continuous across the sheet and are in the end portions 56, 58 of the sheet, the score lines may be made with simple equipment requiring little setup time. Further, if it were desired to change the dimensions of pallet 60, a different size sheet 12 could be employed and the scores could be quickly adjusted appropriately. Thus, it will be apparent that the pallet 60 of FIG. 2 is of simple construction.

Pallet 60 of FIG. 2 is particularly useful where a pallet user wishes to purchase a small quantity of pallets, or where the pallet user is experimenting with a new pallet size. Despite its simplicity, pallet 60 is of solid construction as the blocks 70 maintain the shape of the runners 62, 64 under load.

Figure 4:
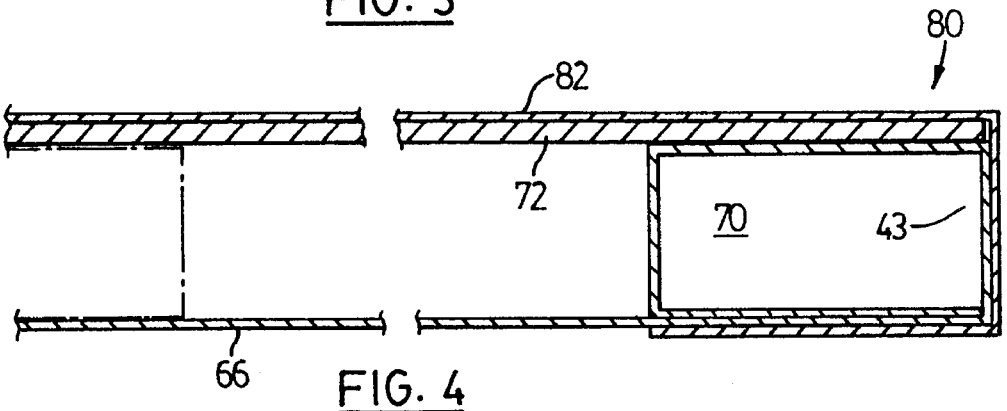
FIG. 4 is a cross-sectional view of a pallet made in accordance with another aspect of this invention.

Turning to FIG. 4, pallet 80 is identical to pallet 60 of FIG. 2 except for the addition of skin 82. Skin 82 covers the outside of second deck 72 and wraps around the outside side walls 43 of each transverse runner and a portion of deck portion 66. The skin provides additional strength to the pallet.

Figure 5:
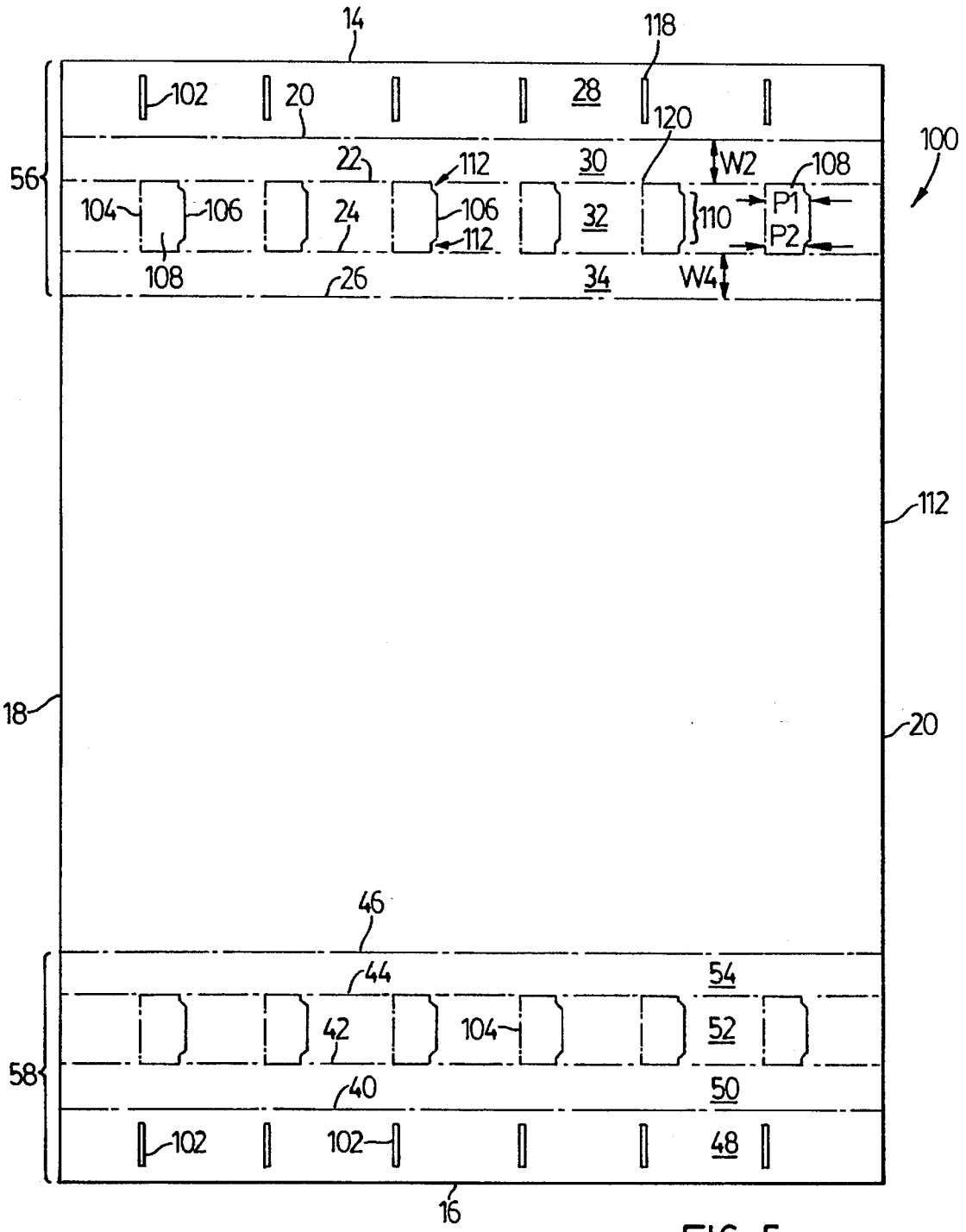
FIG. 5 is a plan view of a pallet blank fabricated from a stiff foldable sheet made in accordance with another aspect of this invention.

FIG. 5 illustrates a pallet blank 100 made in accordance with another aspect of this invention. The blank 100 FIG. 5 is similar to the blank 10 of FIG. 1 and like parts have been given like reference numerals. Turning to FIG. 5, the first zone 28, 48 at each end of the sheet 112 has a plurality of linear slots 102. The third zones 32, 52 have a like plurality of linear score lines 104 and a like plurality of cut lines 106. Each of the third zone score lines 104 is aligned in an end-to-end direction with the associated one of the slots 102. Indeed, in FIG. 5, the score lines 104 are parallel to the sides 18, 19 of the sheet and are therefore collinear. Each cut line 106 begins and ends at its associated score line 104 such that the score line 104 and cut line 106 define a tab 108. A portion 110 of each cut line 106 is parallel to its associated score line 104 and spaced from score line 104 by a perpendicular distance P1, which distance is greater than the width W2, W4 of the second 30, 50 and fourth zones 34, 54.

Considering end portion 56, each score line 104 extends across the width of zone 32. Each slot 102 has a length which is less than that of its associated score line 104 and portion 110 of the associated cut line 106 has a slightly shorter length than the slots 102. Both the cut portions 110 and slots 102 are centered in their respective zones. Thus each cut portion 110 is equidistant from the edges of its zone (i.e., from transverse score lines 22 and 24) and each slot 102 is equidistant from the edges of its zone (i.e., from end 14 and transverse score line 20). Each cut line 106 also has portions 112 at a second perpendicular distance P2 from its associated third zone score line 104. Perpendicular distance P2 is approximately equal to the width W2, W4 of zones 30 and 34. The portions 112 of each cut line extend from the transverse score lines 22 and 24 to a point at a distance from these transverse score lines which is approximately equal to the distance at which slots 102 are spaced from transverse score line 20 and end 14. End portion 58 is identically fabricated.

Figure 6:
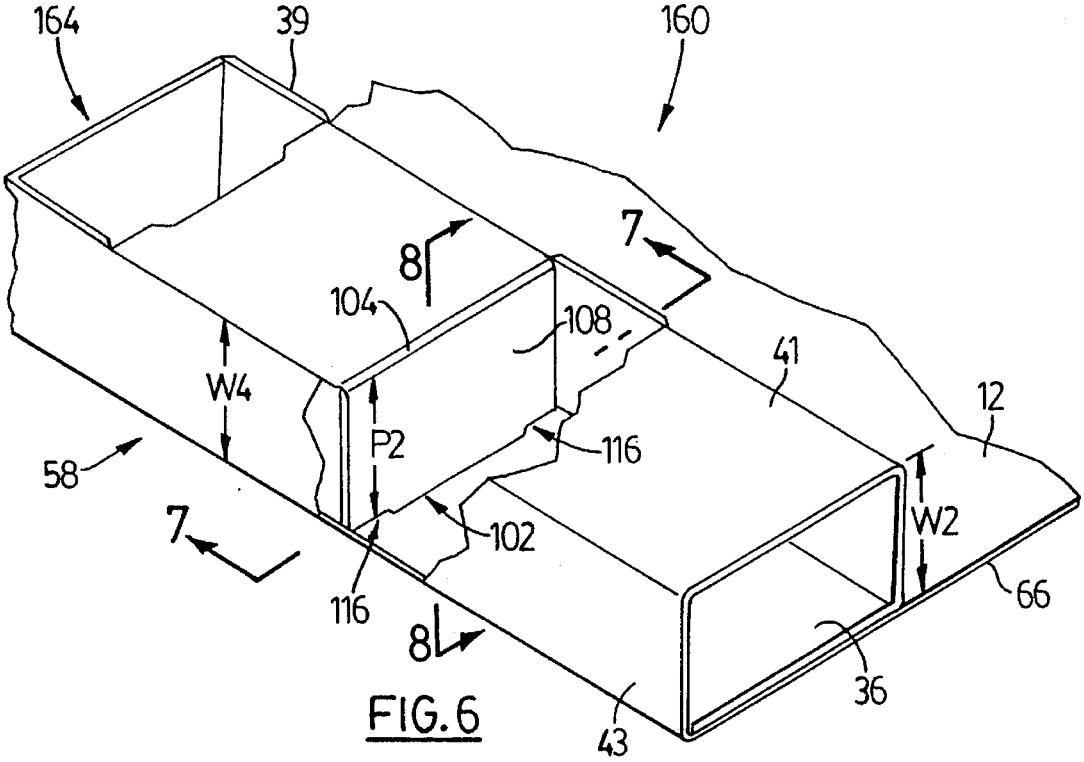
FIG. 6 is a fragmentary perspective view of a pallet incorporating the pallet blank of FIG. 5.
Figure 7:
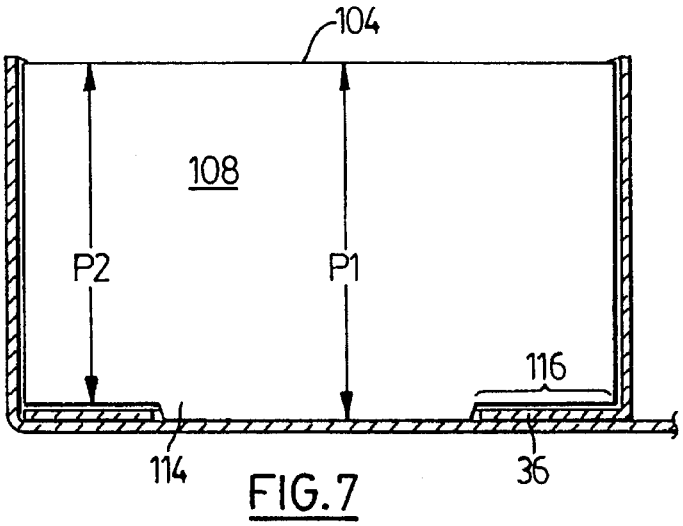
FIG. 7 is a cross-sectional view along the lines of 7—7 of FIG. 6.
Figure 8:
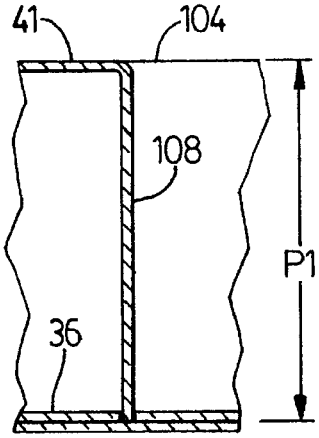
FIG. 8 is a cross-sectional view along the lines 8—8 of FIG. 6.

In order to fabricate a pallet from the pallet blank 100, as before, the end portions 56, 58 are folded back on themselves with right angle folds about each of the four score lines of each end portion. With reference to FIGS. 6 through 8, after folding, and considering end portion 58, the end portion is folded into a runner 164 with the first zone 48 (of FIG. 5) comprising a flap 36 lying adjacent a deck portion 66 of sheet 112, the second zone comprising an inside runner wall 39, the third zone comprising a runner base wall 41, and the fourth zone comprising a runner outside wall. Each tab 108 may then be folded about its score line 104 such that the foot 114 of the tab, extending between distance P1 and distance P2 from the score line 104, enters a slot 102. In this position, the tab is generally perpendicularly directed with respect to the opposed base wall 41 and flap 36. Furthermore, the portions 116 of the tab, being at distance P2 from score line 104, which distance is approximately equivalent to the widths W2 and W4 of the inside and outside runner walls, will firmly abut flap 36.

It will be apparent that the tabs 108, once received within slots 102 of the runner flaps 36, act to stabilize the runners. Thus, the runners will remain erect even with only a sparse amount of glue, or a few staples, holding the flaps 36 to the deck portion 66 of the pallet. Furthermore, since the tabs, when received in their associated slots, support the runners under load, blocks 70 of the pallet of FIG. 2 are not needed within the runners of the pallet of FIG. 6.

While the blank 100 of FIG. 5 has slots in the first zone and tabs in the third zone of each end portion, it will be apparent that the blank could also be fabricated with the slots in the third zone and the tabs in the first zone. Furthermore, the slots could be fabricated in one of the second zone and fourth zone and the tabs in the other of these zones. What is important is that there is one intervening zone between the zone with the slots and the zone with the tabs. Since the first zone becomes the runner flap in the pallet, tabs in the first zone are not preferred since a tab in the flap of the runner is more difficult to manipulate into its associated slot.

While the third zone score lines of FIG. 5 extend across the width of the third zone, this is not required. However, in any event, each slot should have one end, for example end 118, which is spaced a greater distance from the proximate edge of the first zone (defined by end 14) than the distance at which a corresponding end 120 of the associated third zone score line 104 is spaced from a corresponding edge of the third zone (defined by transverse score line 22). This allows a portion of the tab to extend a distance P2 from the third zone score line, which tab portion will then be positioned beside its associated slot in the assembled pallet and snugly abut the flap. Also, the portion of the tab at distance P2 should extend from the edge of the tab to the slot. To ensure this, the portion of the third zone score line which is spaced the distance P2 from the cut line should extend from the end 120 of the third zone score line to a point whereat the distance to the edge of the third zone (defined by transverse score line 22) equals the distance between the corresponding edge of the first zone (defined by end 14) and the corresponding slot end 118 of the slot.

Figure 9:
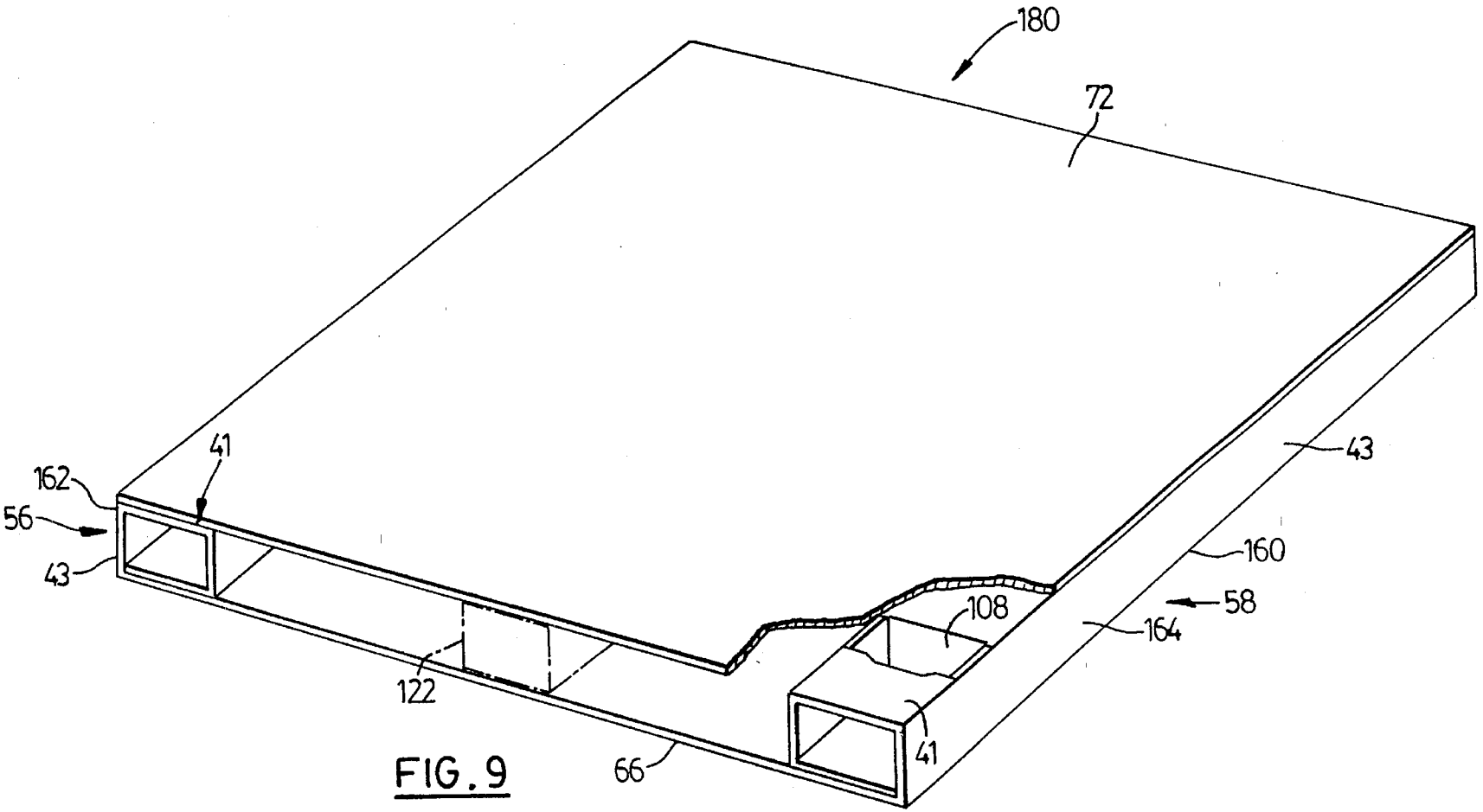
FIG. 9 is a perspective view of a pallet incorporating the pallet blank of FIG. 5.

FIG. 9 illustrates a pallet 180 comprising the pallet 160 of FIGS. 6 through 8 with a second deck 72 running between the outside side walls runners 162, 164 and attached to the base walls 41 of the runners. In addition, an optional medial runner is illustrated in chain dot at 122. The central runner would comprise a piece of stiff foldable sheet material right-angle folded into a box shape and containing one or more stabilizing blocks of the type shown at 70 in FIG. 2. The central runner would be affixed to the deck portion 66 of pallet 160. The second deck 72 will maintain flaps 36 against deck 66. Therefore, with the pallet 180 of FIG. 9, flaps 36 do not need to be affixed to the pallet deck 66.

The pallets 160 (of FIG. 6) and 180 (of FIG. 9) require little glue (or few staples), which is desirable since many glues (and all staples) are not truly recyclable with pulp. Further, excess materials add to expense and glue is messy.

It will be apparent that, in use, the runners of pallet 160 will be directed downwardly and the pallet load will be supported on the deck portion of the pallet. With the pallet 180, deck 66 will be directly downwardly and the second deck will support the load. Pallets 160 and 180 are formed from a blank 100 having a series of cuts and slots. Thus, pallet blank 100 of FIG. 5 is of more complicated fabrication than the pallet blank 10 of FIG. 1. However, since the cuts and slots are in the end portions of the blank 100 and since the same cuts and slots are repeated across the blank, the dies required to cut blank 100 are relatively simple and may be set up relatively quickly. Because blank 100 requires somewhat more expensive setup than blank 10 of FIG. 1, blank 100 is appropriate for larger runs.

Figure 10:
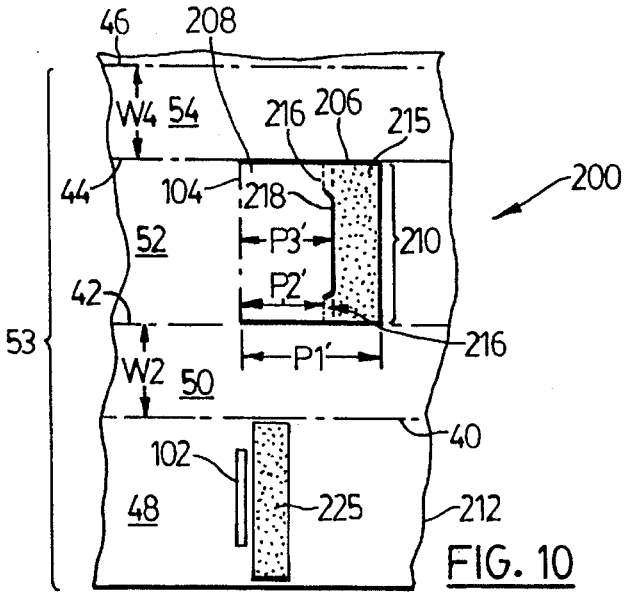
FIG. 10 is a fragmentary plan view of a pallet blank fabricated from a stiff foldable sheet made in accordance with another aspect of this invention.

Turning to FIG. 10, blank 200 is similar to blank 100 and like parts have been given like reference numerals. In blank 200, the cut lines 206 associated with each third zone score line 104 begin and end at the third zone score line to define a tab 208. A subsidiary third zone score line 216 extends parallel to third zone score line 104 from either side of tab 208 at a distance P2' from the associated third zone score line 104. The distance P2' is substantially equal to the widths W2, W4 of zones 50 and 54, respectively. The subsidiary third zone score lines extend inwardly into tab 208 from cut line 206. Tab 208 has a second cut line 218 extending between the two third zone subsidiary score lines 216. The middle portion of the second cut line 218 is parallel to the associated third zone score line 104 and is spaced therefrom at a distance P3'. Portion 210 of cut line 206 is parallel to its associated third zone score line 104 and is spaced from the score line 104 at a distance P1'. P1' is greater than the width W2, 24 of the second and fourth zones 50, 54. It will be noted that distance P3' is a larger distance than P2' but is a smaller distance than distance P1'.

Each tab 208 has a glue pad 215 extending from the second cut line 218, at distance P3' from score line 104, to the portion 210 of cut line 206, which is at distance P1' from score line 104. Additionally, each slot 102 has a glue pad 225 adjacent the side thereof which corresponds to the side of the associated third zone score line 104 from which tab 208 extends. Each glue pad preferably comprises an adhesive of the type which will only adhere to itself.

Figure 11:
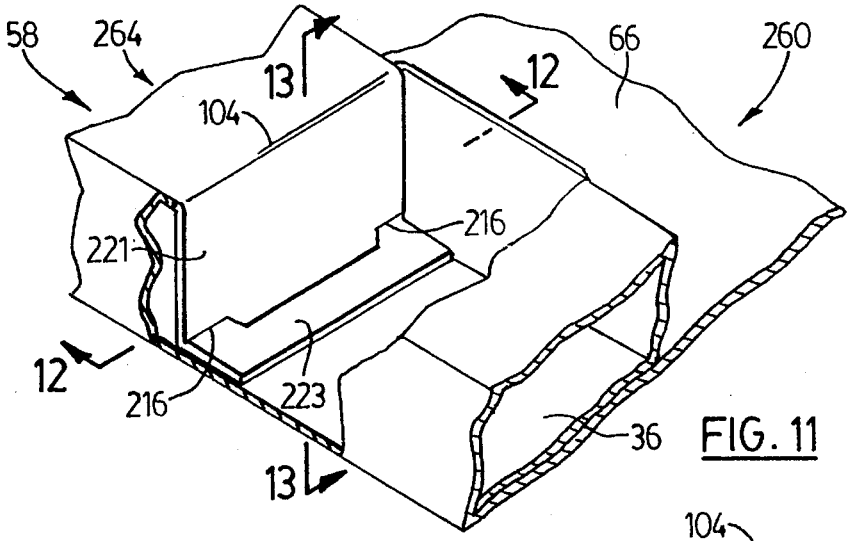
FIG. 11 is a fragmentary perspective view of a pallet fabricated from the pallet blank of FIG. 10.
Figure 12:
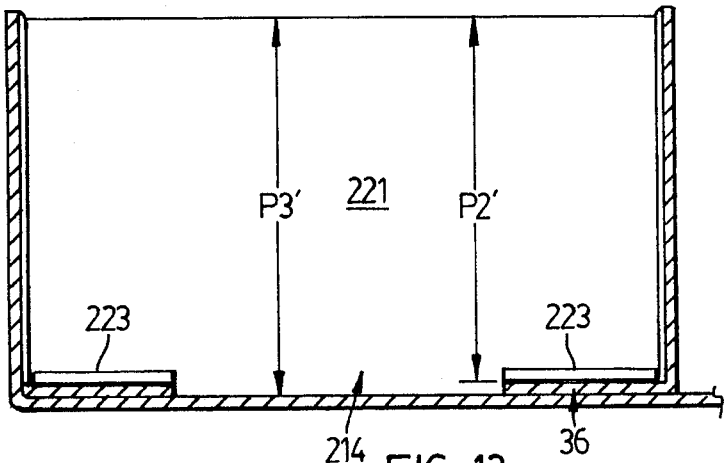
FIG. 12 is a cross-sectional view along the lines 12—12 of FIG. 11.
Figure 13:
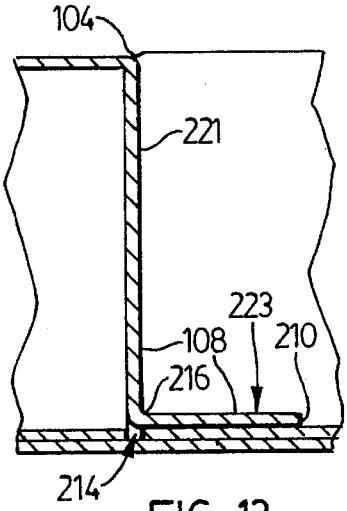
FIG. 13 is a cross-sectional view along the lines 13—of FIG. 11.

Pallet blank 200 may be fabricated into pallet 260 of FIGS. 11 through 13. More particularly, end portion 58 of sheet 212 (FIG. 10) may be folded in on itself with right angle folds at transverse score lines 40, 42, 44, and 46. Then each tab 208 may be deflected about score line 104 so that, as shown in FIGS. 11 through 13, a first portion 221 of the tab is generally perpendicularly directed with respect to flap 36 and base wall 41 with a tab foot 214 received within an associated slot 102. A second portion 223 of the tab folds about score lines 216 and lies adjacent flap 36. In this position glue pad 215 overlies glue pad 225 and the two pads adhere to each other so that portion 223 of tab 208 adheres to flap 36.

From the foregoing, it will be apparent that pallet 260 is similar to pallet 160 of FIG. 6, however, the adherence of each tab portion 223 to the flap of the transverse runner ensures that each tab 208 remains fixed in its associated slot 102. While it is preferred that there is a glue pad associated with tab 208 and with slot 102, with the adhesive of each pad being such that it only adheres to itself, other adhesive types are possible in which case only one glue pad would be required. In such instance, the single glue pad could either be associated with slot 102 or with tab 208. As with pallet 160 of FIG. 6, pallet 260 may have a second deck affixed to the base walls of its transverse runners.

Figure 15:
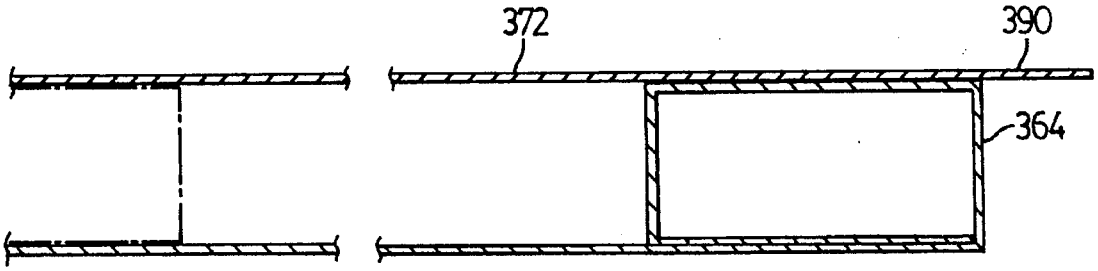
FIG. 15 is a cross-sectional view of a portion of FIG. 14.
Figure 14:
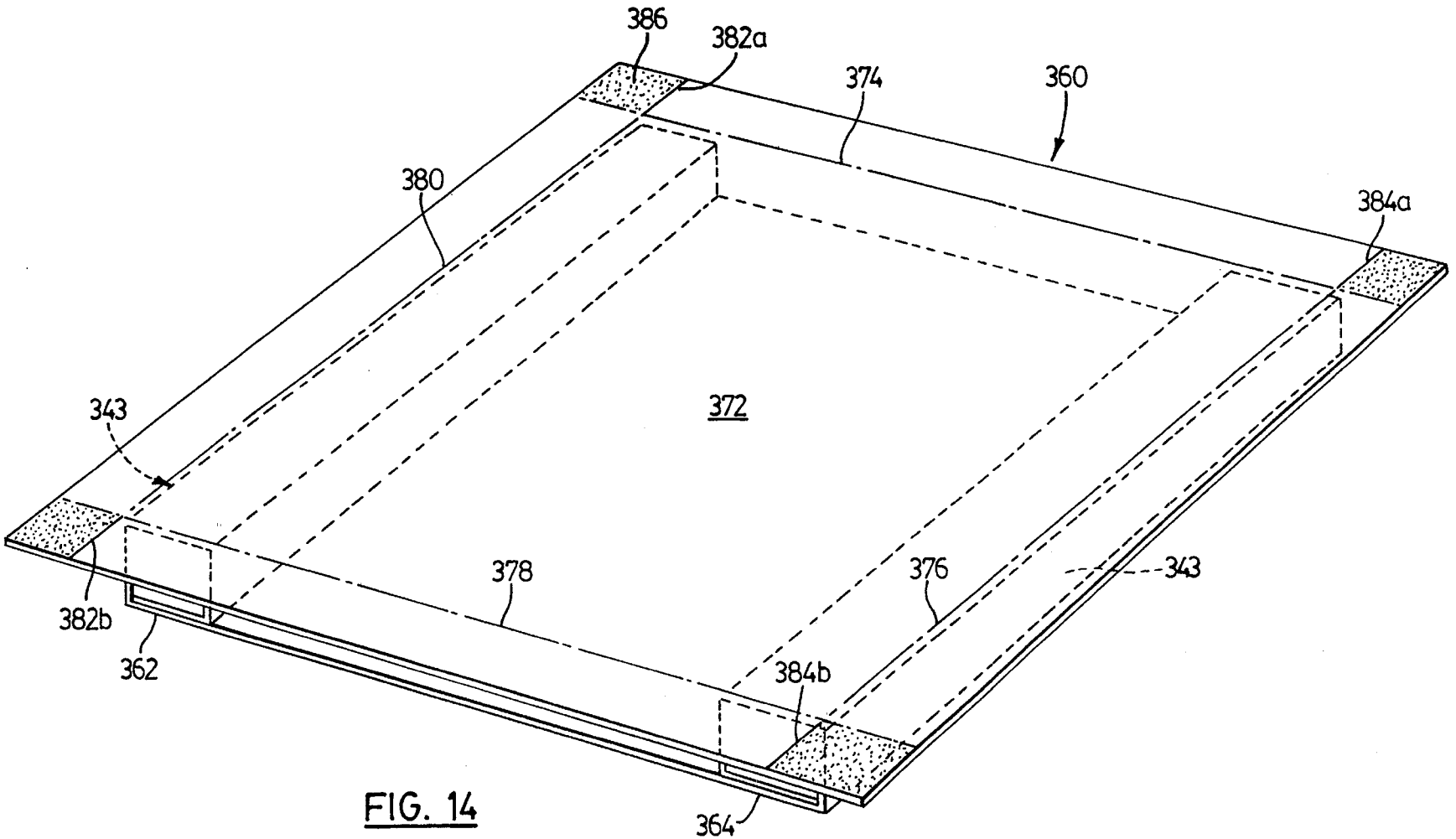
FIG. 14 is a perspective view of a partially assembled pallet made in accordance with a further aspect of this invention.

Turning to FIGS. 14 and 15, the second deck 372 of pallet 360 extends beyond the outside walls 343 and the ends of the runners 362, 364 of the pallet. The second deck has score lines 374, 376, 378, and 380 which extend along the outside edges and ends of the runners 362, 364. The score lines 374, 378 extend from one side of the deck 372 to the other whereas the score lines 376 and 380 extend between score lines 374 and 378 and terminate in cut lines **382*a*, 382*b*, 384*a*, 384*b* which extend from each end of score lines 374, 378 to opposed ends of the second deck 372. There is a glue pad 386 in each corner defined by cut lines 382*a*, 382*b*, 384*a*, 384*b* and score lines 374, 378**.

Figure 17:
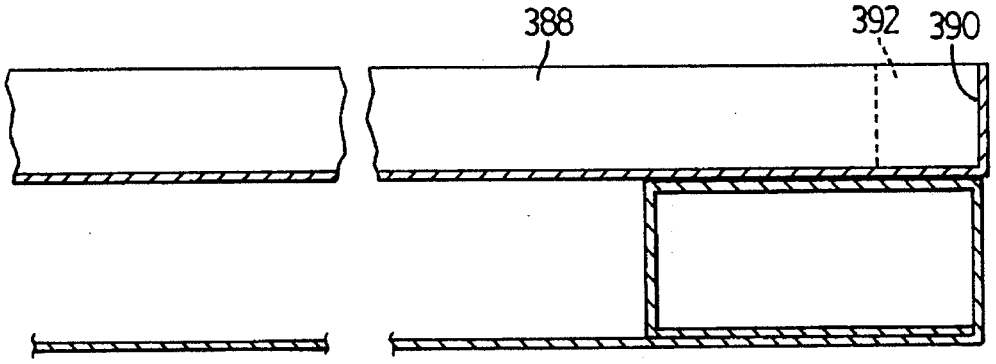
FIG. 17 is across-sectional view of a portion of the pallet of FIG. 16.
Figure 16:
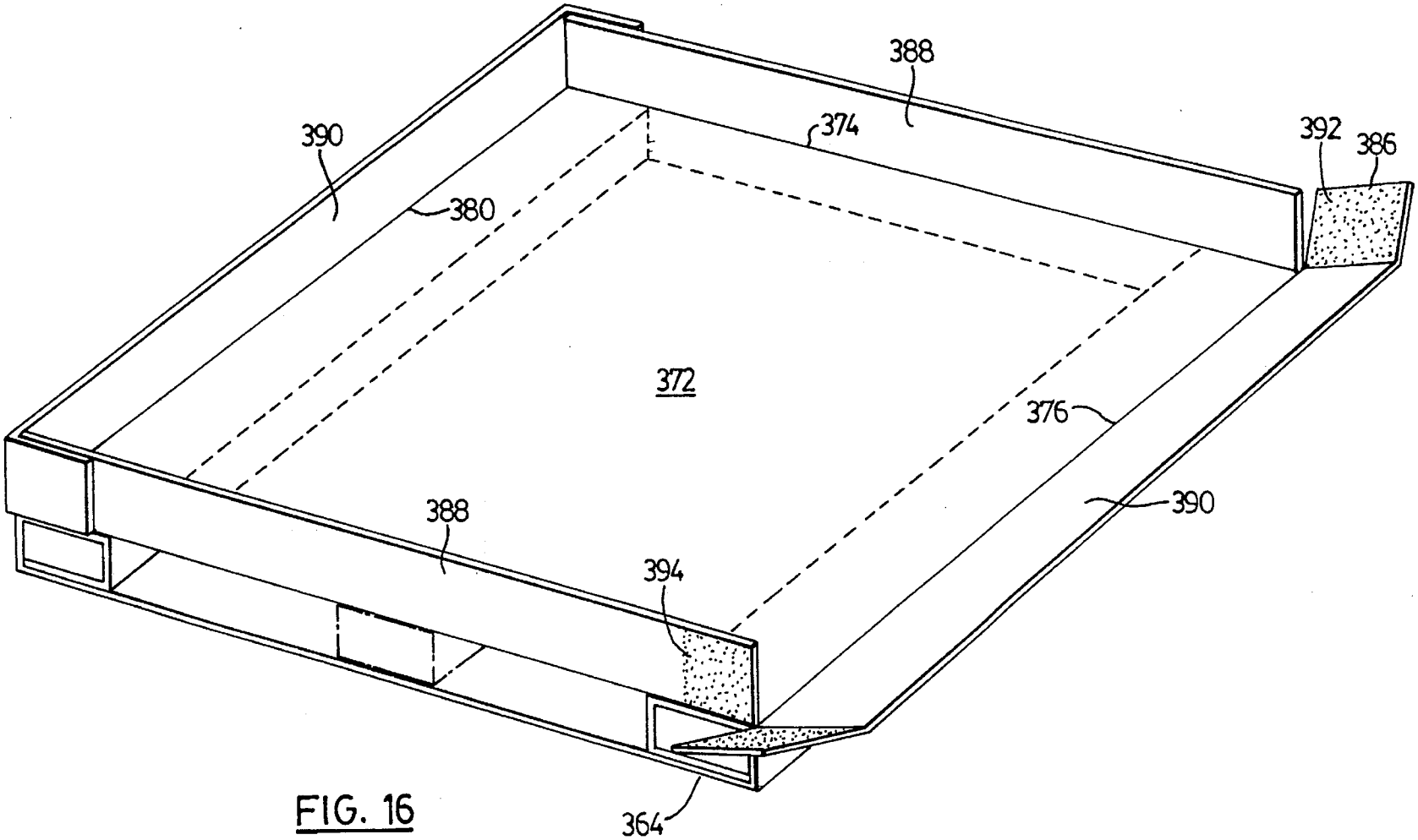
FIG. 16 is a perspective view of the pallet of FIG. 14 shown more completely assembled.

Turning to FIGS. 16 and 17, right angle folds may be made at each of score lines 374, 376, 378, and 380 so as to form upstanding marginal walls 388, 390. The corner pieces 392 having glue pads 386 are folded into contact with the outside of upstanding marginal walls 388. It will be noted from FIG. 16 that the outside of marginal walls 388 have glue pads 394 at their ends. Thus, glue pads 386 and 394 may comprise adhesive of the type which adheres only to itself so that marginal walls 388 and 390 are fixed in position when the glue pads 386 are mated with the glue pads 394.

Instead of gluing corner pieces 392 to walls 388, the corner pieces may be stapled in place, or a tab lock may be formed between the corner pieces and walls.

It has been found that the right angled walls 388 and 390 of the second deck 372 greatly enhances the flexural strength of the pallet.

Figure 18:
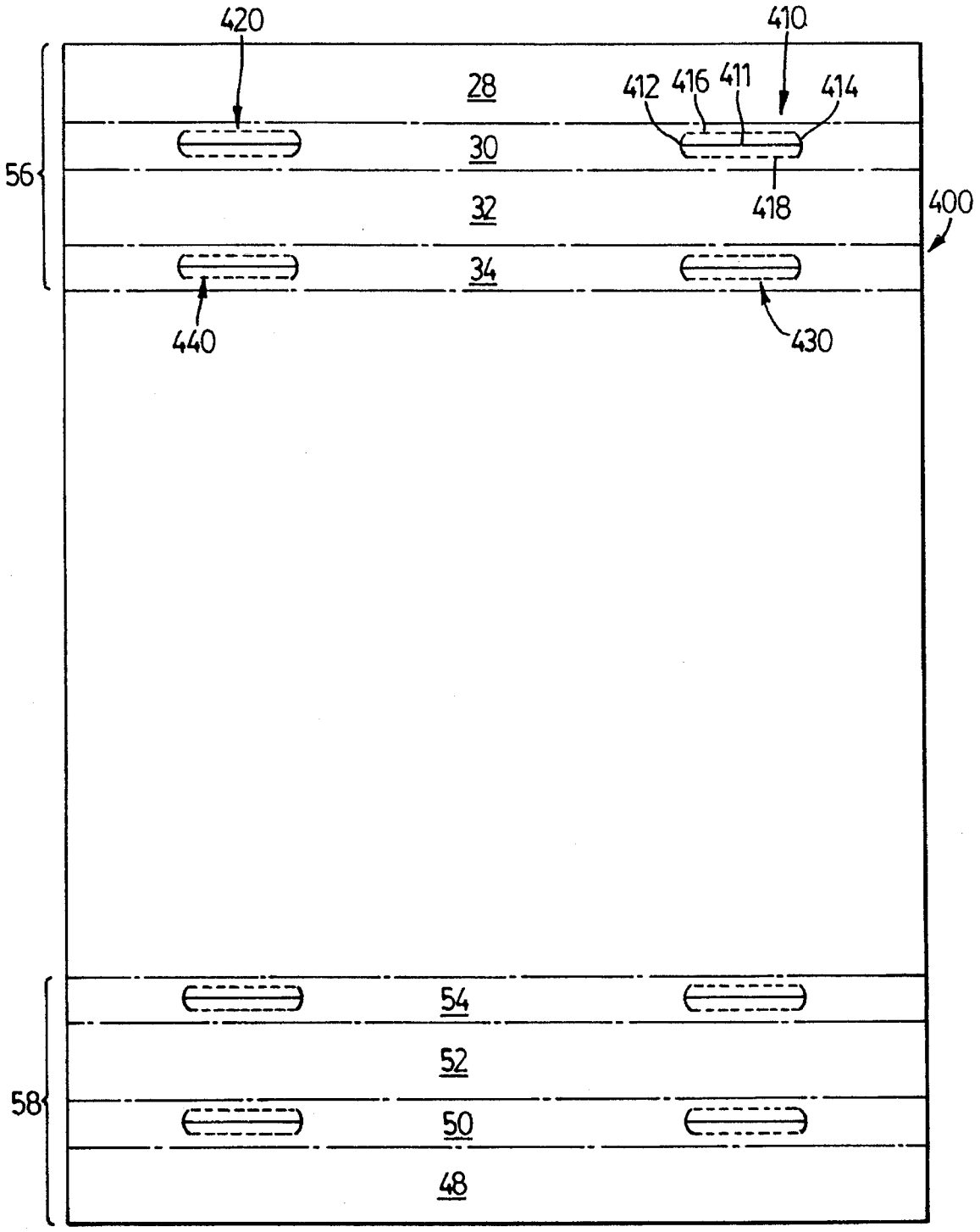
FIG. 18 is a plan view of a pallet blank fabricated from a stiff foldable sheet made in accordance with another aspect of this invention.

Turning to FIG. 18, blank 400 is similar to blank 10 of FIG. 1 and like parts have been given like reference numerals. Considering end portion 56, zone 30 has a slot blank 410 comprising tranverse cut line 411 terminating at either end in an arcuate cut lines 412 and 414. Score lines 416 and 418 extends between opposed ends of the arcuate cut lines 412 and 414. Zone 30 also has a laterally spaced second slot blank 420 which is identical to slot blank 410. Zone 34 has slot blank 430 which is longitudinally aligned with slot blank 410 of zone 30 and slot blank 440 which is longitudinally aligned with slot 420. End portion 58 has a like arrangement of slot blanks.

Figure 19:
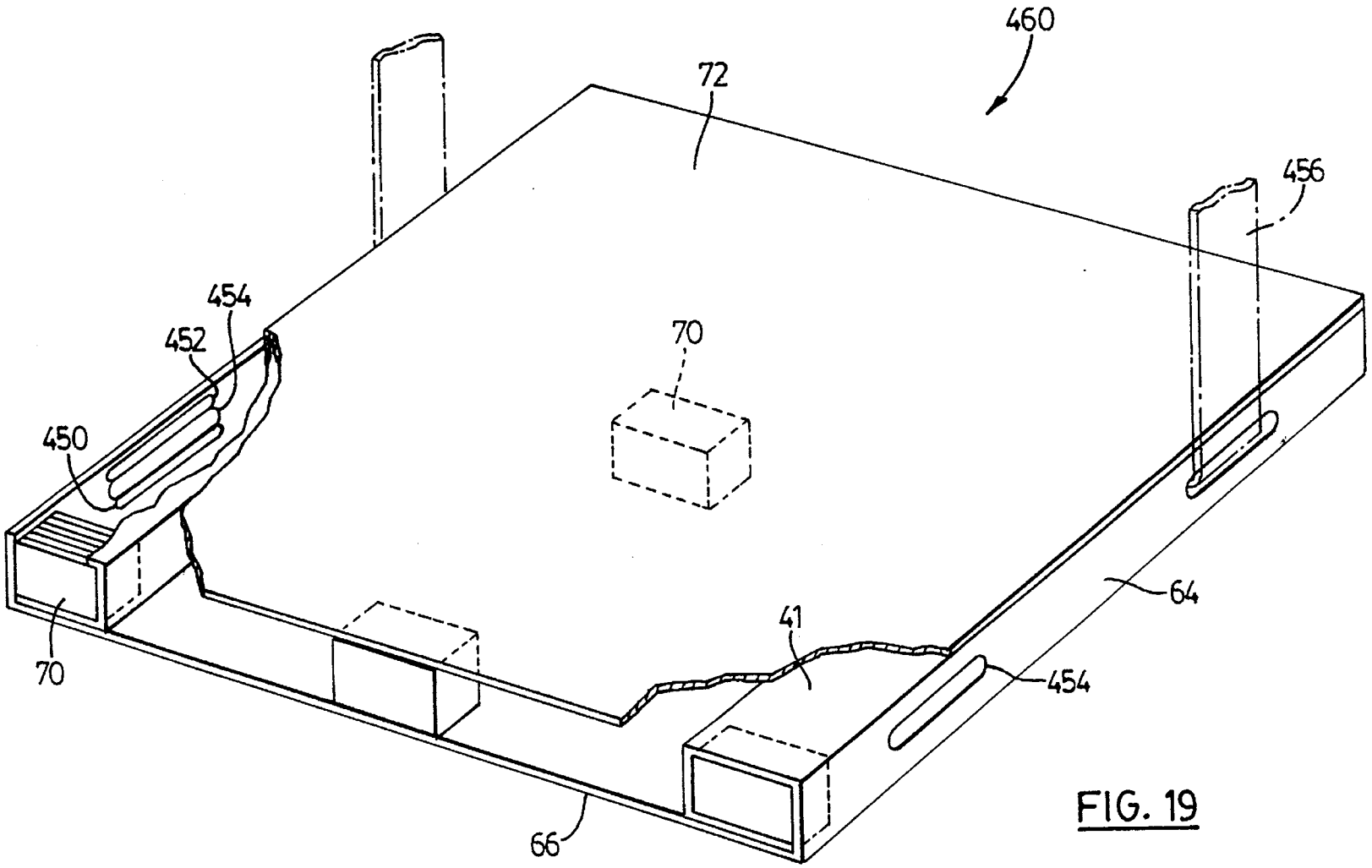
FIG. 19 is a perspective view of a pallet incorporating the sheet of FIG. 18.

With reference to FIG. 19 as well as FIG. 18, similarly to the blank 10 of FIG. 1, end portions 56, 58 may be folded back on themselves and glued in place to form runners 62 and 64. These runners are then reinforced with blocks 70 and a second deck sheet 72 glued in position. By pushing on either side of a transverse cut line of a slot blank (of FIG. 18), flaps 450 and 452 (of FIG. 19) will fold inside the runners leaving a slot 454 therebetween. By opening the slots in both sides of both runners, strapping, illustrated in chain dot in FIG. 19 at 456, may be received through aligned slots in both runners and pass around a load on the pallet deck 72 in order to strap the load in place. The flaps 452 are important because they prevent the strapping from digging into the fluting of the corrugate. In other words, without flaps 452, the slot edges would comprise exposed fluting which the strapping would encounter and dig into. Also, if the pallet is used with deck portion 66 as the load bearing surface, then flaps 450 prevent strapping from digging into the fluting.

Slots 454 will also accommodate the forks of a forklift truck. Consequently, pallet 460 will receive the forks of a forklift either with these forks parallel or perpendicular to runners 62, 64. Therefore, pallet 460 may be approached from any of its four sides by a forklift.

It will be apparent that the blank 100 of FIG. 5 and 200 of FIG. 10, could be modified to incorporate the slot blanks of the type shown in FIG. 18.

It will be apparent to those skilled in the art that the cut lines described in connection with blanks 100 of FIG. 5, and 200 of FIG. 10 may be fabricated as perforation lines which are punched out during assembly of the pallets. While the blanks of FIGS. 1 and 5 are shown as rectangular in shape with the transverse distance between the sides of the blank being less than the end-to-end distance, it will be apparent that this could be reversed such that the transverse distance was greater than the end-to-end distance.

Other modifications will be apparent to those skilled in the art and, therefore, the invention is defined in the claims.

What is claimed is:

1. A pallet blank fabricated from a stiff foldable sheet having two opposed ends and two opposed sides, said blank comprising:

proximate each end of said sheet:

a first transverse score line parallel to said end of said sheet and adjacent thereto and extending from one side of said sheet to a second side of said sheet, such that a first zone is defined between said first score line and said end;

a second transverse score line parallel to said end of said sheet and adjacent to said first score line and extending from said one side of said sheet to said second side of said sheet, such that a second zone is defined between said second score line and said first score line;

a third transverse score line parallel to said end of said sheet and adjacent to said second score line and extending from said one side of said sheet to said second side of said sheet, such that a third zone is defined between said third score line and said second score line;

a fourth transverse score line parallel to said end of said sheet and adjacent to said third score line and extending from said one side of said sheet to said second side of said sheet, such that a fourth zone is defined between said fourth score line and said third score line;

said second zone and said fourth zone having substantially the same width;

said first zone and said third zone having substantially the same width;

one of said first zone, said second zone, said third zone, and said fourth zone, having a plurality of linear slots and another of said first zone, said second zone, said third zone, and said fourth zone, which is spaced from said one zone by an intervening zone, having a like plurality of linear score lines and a like plurality of cut lines, each of said another zone score lines being aligned in an end-to-end direction with an associated one of said slots, each of said cut lines beginning and ending at an associated one of said another zone score lines such that said cut line with said associated another zone score line defines a tab, with a first perpendicular distance from said associated third zone score line to a portion of said cut line being greater than the width of said intervening zone.

2. The pallet blank of claim 1 wherein each of said slots has a length less than the length of said associated another zone score line such that each said slot has a slot end spaced a greater distance from a proximate edge of said one zone than the distance at which a corresponding end of said associated another zone score line is spaced from a corresponding edge of said another zone, said cut line configured such that there is a second perpendicular distance between a portion of said associated another zone score line and a like portion of said cut line, which second perpendicular distance is approximately equal to the width of said intervening zone, said portion of said another zone score line extending from said corresponding end to a point whereat the distance to said corresponding edge of said another zone equals the distance between said edge of said one zone and said slot end of said slot.

3. The pallet blank of claim 2 wherein each of said slots and each of said another zone score lines is parallel to one of said sides of said sheet.

4. The pallet blank of claim 3 wherein each of said cut lines has a portion parallel to said associated another zone score line and spaced at said first perpendicular distance therefrom.

5. The pallet of claim 4 wherein said one zone is said first zone, said another zone is said third zone, and said intervening zone is said second zone.

6. The pallet blank of claim 1 including, for each of said tabs, a subsidiary another zone score line parallel to said another zone score line and spaced therefrom at a second perpendicular distance approximately equal to the width of said intervening zone, said subsidiary another zone score line extending within said tab from said cut line, a second cut line extending within said tab from said subsidiary another zone score line, said second cut line configured such that a third perpendicular distance from a portion of said another zone score line to a portion of said second cut line is greater than said second perpendicular distance and is less than said first perpendicular distance.

7. The pallet blank of claim 6 including, for each of said tabs, at least one of (i) a glue pad extending between said portion of said second cut line at said third perpendicular distance and said portion of said cut line at said first perpendicular distance and (ii) a glue pad adjacent a corresponding side of an associated slot.

* * * * *